United States Patent [19]

Emonet

[11] 4,319,646

[45] Mar. 16, 1982

[54] ROTARY TOOL DRIVE SYSTEM FOR A JACK HAMMER

[76] Inventor: Henri Emonet, 12 rue R.P. Couturier, Montbrison, Loire, France

[21] Appl. No.: 943,722

[22] Filed: Sep. 19, 1978

[51] Int. Cl.[3] ..... B25D 15/00

[52] U.S. Cl. ..... 173/111

[58] Field of Search ..... 173/109, 104, 110, 111, 173/93, 93.5, 97

[56] References Cited

U.S. PATENT DOCUMENTS

| | | | |
|---|---|---|---|
| 670,543 | 3/1901 | Paulson | 173/111 |
| 739,440 | 9/1903 | Oldham | 173/111 |
| 1,141,650 | 6/1915 | Oldham | 173/111 |
| 3,275,088 | 9/1966 | Schrottle | 173/110 |
| 3,837,410 | 9/1974 | Maxwell | 173/109 |

FOREIGN PATENT DOCUMENTS

| | | | |
|---|---|---|---|
| 1189035 | 3/1965 | Fed. Rep. of Germany | 173/104 |

*Primary Examiner*—Werner H. Schroeder
*Assistant Examiner*—Andrew M. Falik
*Attorney, Agent, or Firm*—Remy J. VanOphem

[57] ABSTRACT

The invention is a rotary drive system for a jack hammer which incorporates a plurality of annular sleeves to transfer the motion generated by the piston to the tool holder and thereby allows the piston to strike the tool when the piston moves in the forward direction. Upon the return stroke of the piston, the annular sleeves are provided with mutually engaging helical splined teeth which causes a partial rotation of the tool holder and thereby provides rotation of the tool holder prior to the piston's next impact with the tool. All of the components are annular and, therefore, easily assembled into the bore of the jack hammer housing. Also, the use of helical splines significantly reduces the frictional resistance of the complete system.

7 Claims, 14 Drawing Figures

ROTARY TOOL DRIVE SYSTEM FOR A JACK HAMMER

BACKGROUND OF THE INVENTION

1. Field of the Invention

The present invention pertains to an apparatus designed to drive the tool of a jack hammer drill in rotation.

2. Description of the Prior Art

In the prior art jack hammers the above mentioned rotation of the tool is induced by an apparatus which includes a free sprocket wheel, which is designed to receive ratchets that are supported by radial springs. This traditional apparatus has several disadvantages.

Two ratchets are generally used, which are spaced half a pitch from one another (the pitch referred to, being that of the sprocket wheel). The fragility of the apparatus is therefore due to the fact that only one ratchet is meshed at any given time to induce the rotation of the tool.

The ratchet return springs are continuously subjected to tension and compression forces, everytime a gear of the sprocket wheel meshes. The springs easily lose their elasticity.

The mounting of the free sprocket wheel, on the piston, requires special provisions for the positioning of the ratchets and springs. Thus, the traditional tool rotating apparatus used on jack hammers requires a considerable increase of the working diameter of the jack hammer body.

The installation and assembly of the drill is time consuming and the drill is difficult to operate.

The aforementioned disadvantages should be eliminated by the present invention which calls for a rotating apparatus that is directly controlled by a reciprocating piston, through an axial shift dog.

SUMMARY OF THE INVENTION

The rotary drive apparatus which is the subject of the invention is designed for a jack hammer whose cylindrical body houses the reciprocating motion of a piston. At the end of its percussion stroke, the piston transfers its power to the tool. The piston walls include helical and straight grooves which are designed to mesh with the lugs or mutual protrusions provided on the internal components of the apparatus body. At least one of these components can move axially and in rotation, so as to be engaged or disengaged from one fitting member. Means are provided to tie the tool and the piston in rotation.

The moving part moving a member and the fitting member include, on their adjoining sections, a number of gears which mesh and unmesh depending on the axial position of the moving part. An axial dog clutch or dogging system is therefore obtained when simultaneously using all of the gears.

According to another feature an intermediate part or a member is provided between the rear face of the tool or tool holder including a polygonal axial bore, and the front end of a tooth profile which is fitted in the hammer's body. This part can rotate even when it is fixed in the axial direction.

According to an additional feature of the invention, the apparatus includes all of the following annular pieces:

First, a first moving member moving both axially and in rotation so as to act as a free wheel or a mobile dog clutch. The internal wall of the axial bore includes helical gears which are designed to interface with the helical grooves of the piston.

The apparatus also includes a bored, rotating part or second rotating member including a dog clutch on its front face, so as to engage the tool holder. The axial bore of the second rotating member includes straight gears which are pointing inside and are designed to interfere with the straight, or axial grooves of the piston.

The mobile dog clutch slide seat consists of a part fitted into the body of the apparatus, that part being also used as a stop piece for the rotating part or second rotating member.

A fitting member is provided, which includes a set of gears forming a crown on its front face, and designed to interface with the complementary gears cut on the rear cross face of the mobile dog clutch.

The assembly is complete with the tool holder permanently engaged on the second moving member. The rotary drive is supplied by the reciprocating piston which remains meshed in gear, through its grooves, with the second moving member or rotating part and with the mobile dog clutch.

According to another feature of the invention, all rotary parts are mounted through the upper end or the back of the apparatus body. The apparatus body consists of a single piece, and all of the components of the apparatus may be extracted from the back of the bore provided in the compact body.

Here are some main advantages of this invention:

The body of the drill is compact. The housings are no longer required to accomodate the various ratchets and springs found in the prior art designs.

All of the clutch engagement gears 26 and 27 interface with one another; a large number of these gears may be provided. The sturdiness of the apparatus is thus improved and, in the case of a given stress level, it is possible to use parts which are made of lighter duty, less expensive materials.

The apparatus is designed for a unitized construction of the drill body which requires only simple machining operations.

The fact that all parts are introduced and extracted from the back, simplifies the assembly and disassembly of the jack hammer.

The attached, schematic drawing gives a better understanding of the construction, the operation and of the advantages of the apparatus according to the invention.

DESCRIPTION OF THE PREFERRED EMBODIMENT

Figure 1:
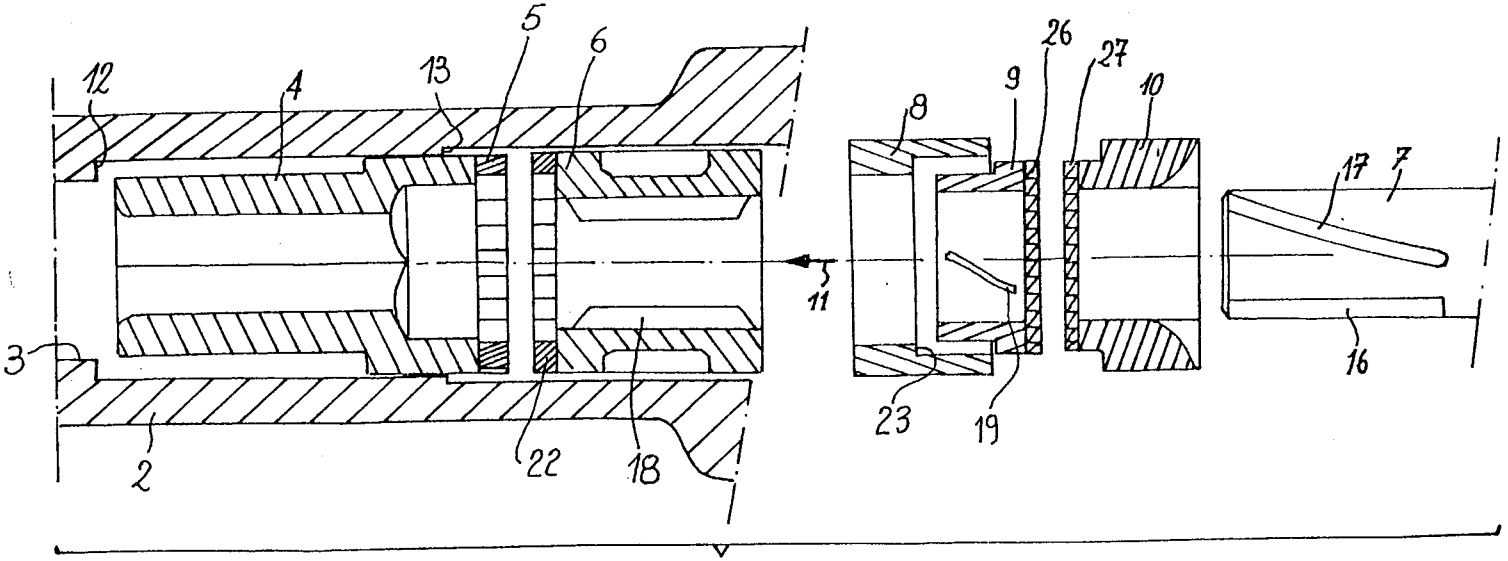
FIG. 1 is a breakdown view showing the axial cross-section of the various components of the rotary apparatus, designed for a jack hammer drill.
Figure 9:
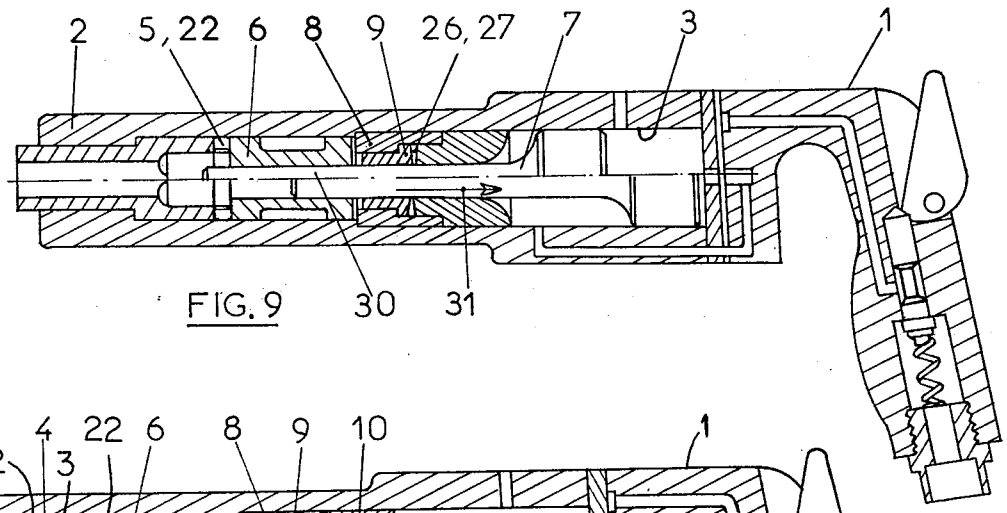
FIG. 9 illustrates the operation of the drill after assembly of the rotary apparatus components.

FIG. 1 gives an illustration of the main components of a rotary apparatus designed for a jack hammer drill 1 shown in FIG. 9. The body 2 of the drill 1 is schematically illustrated to show its axial bore 3, in which all of the parts are shown in cross-sectional view in FIG. 1 as they are mounted and positioned in the jack hammer drill.

The rotary apparatus consists of the following parts:

A tool holder 4 in which an hexagonal bore is provided to receive the tool shank of a tool (not shown). The back edge of this tool holder 4 is cut so as to include a number of notches or slots 5 which are equally spaced on its circumference. The rest of this part is constructed in the traditional fashion.

Figure 4:
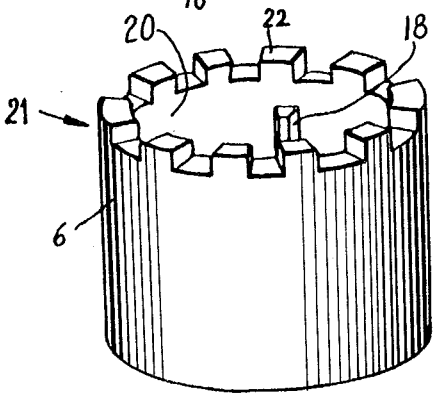
FIG. 4 shows a view of the mobile part with the tool holder.

A link or mobile part or moving member 6 shown in FIG. 4 is cut so as to include gears which tie the piston 7 and the tool holder 4 in rotation. The structure of this part is further detailed on FIGS. 9 and 10.

As shown in FIG. 1, a fitting or first member 8 is mounted in the bore 3. This fitting member also includes a bore so as to constitute an axial and rotary slide for the mobile dog clutch 9.

A free part 9, also called a mobile dog clutch, or a housing shaft dog has a bore and a number of gears to interface with a fitting member 10. The mobile dog clutch 9 may rotate and move axially. As indicated hereinafter, this mobile dog clutch is directly controlled by the piston 7.

Figure 8:
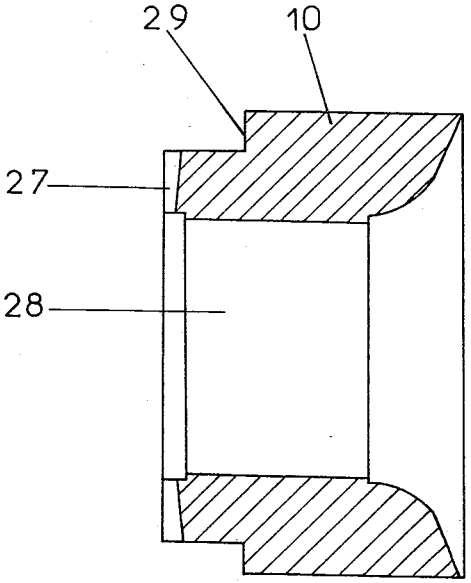
FIGS. 7 and 8 show a detail (elevation and cross-section) of the fitting mounted into the bore of the drill body.
Figure 7:
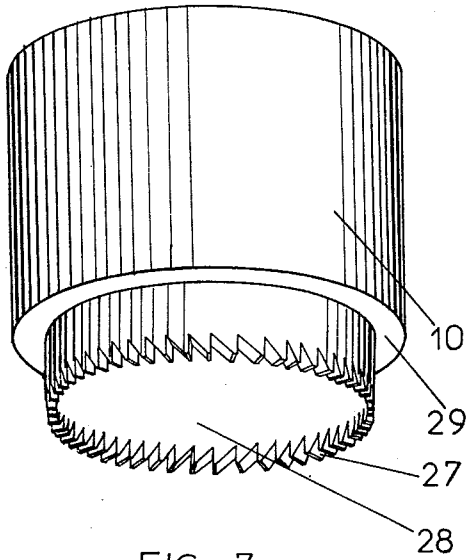

The fitting member 10 represents the fixed component of the rotary apparatus. FIGS. 7 and 8 show the details of this part.

The reciprocating piston 7 of the jack-hammer drill 1, is also used to control the rotary apparatus.

Figure 10:
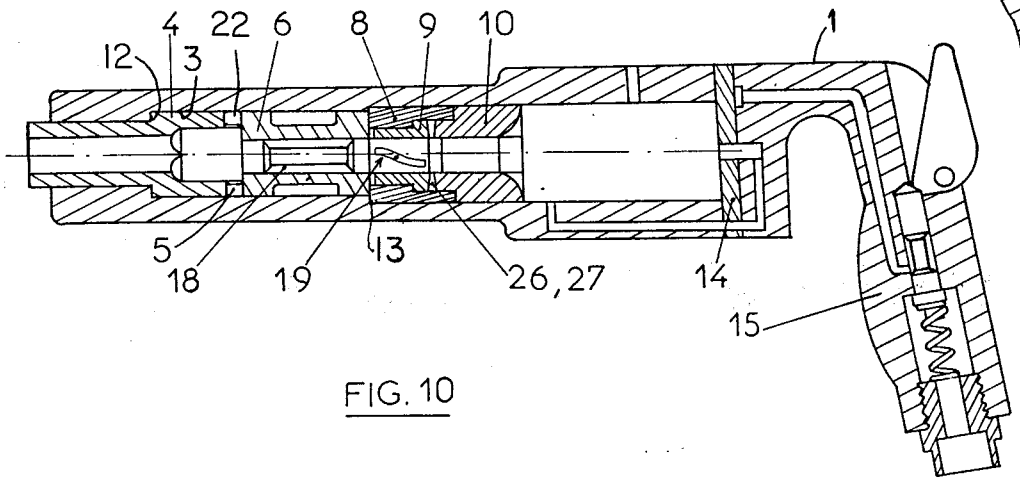
FIG. 10 shows an axial cross-section of the annular parts assembly, before installing the piston.

As shown in FIG. 1, all of these components, or basic parts, are introduced through the bore of the drill body, following the direction of Arrow 11, that is from the back of the drill body. The body 2 may therefore be made of a single piece. The counterbores 12 and 13 are provided to position the parts axially along the bore 3. Following the installation of the parts and of the piston, the compressed air manifold 14 and the control handle 15 may be mounted thereon as shown in FIG. 9 and 10.

Figure 2:
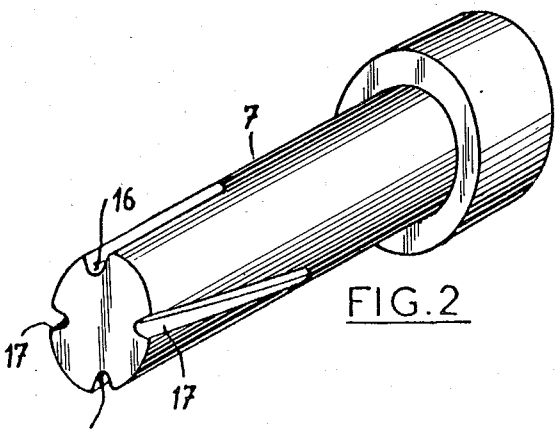
FIGS. 2 and 3 respectively show a elevation and a front view of the grooved position.
Figure 3:
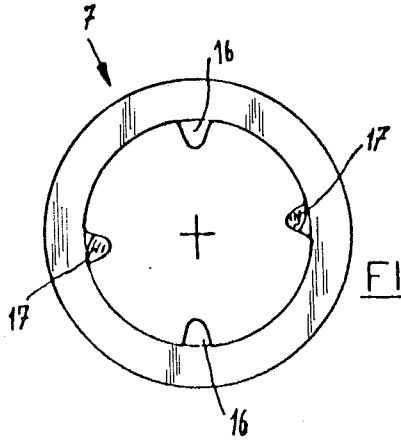

The piston 7 transmits, in an ordinary fashion, its impact onto a tool held by the tool holder 4. As illustrated on FIGS. 2 and 3, the side-wall of the piston includes four grooves, namely:

Two straight grooves that are parallel to the axis of the piston. Both of these grooves 16 being constantly meshed with the axial gears or salient teeth 18 which are provided on the internal side-wall of the bored link or moving member 6 (FIG. 4).

Figure 6:
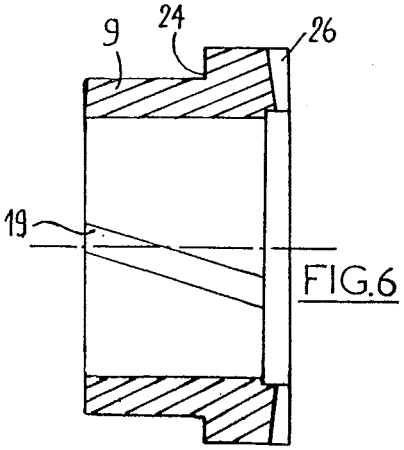
FIGS. 5 and 6 respectively show an elevation and a cross-section of the mobile dog clutch.
Figure 5:
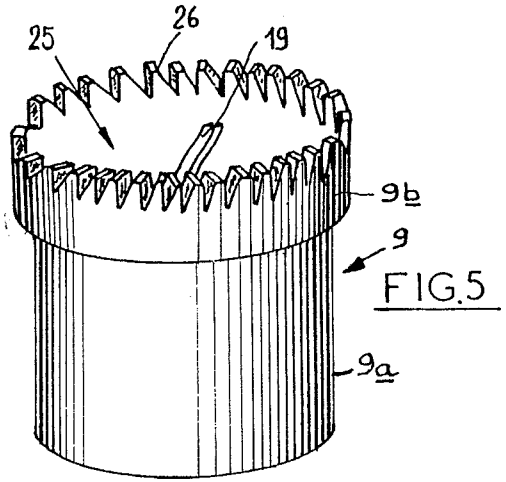

Two helical grooves 17, positioned at about 90° with reference to the axial grooves 16 are designed to interface with the helical gears or teeth 19, provided in the bore of the mobile dog clutch 9 (FIGS. 5 and 6).

These grooves enable the piston 7 to control the rotation of the rotary drive apparatus.

The mobile part or moving member 6 has the general shape of a ring as shown in FIG. 4. The side-wall of its bore 20 includes straight, axial gears or teeth 18. Its front end 21 is indented in such a way that it includes radial gears or teeth 22 which are equally spaced along the circumference. The width of each gear tooth equals the distance separating two consecutive gear teeth. An indented face is thus obtained, which can mesh with the back edge 5 of the tool holder 4, on which identical gears have been cut. The back edge of the moving member 6 is positioned to stop against the front face of the fixed part or first member 8 which is also used as the seat for the free dog clutch 9. The detail of the mobile part or moving member 6 is shown on FIG. 4, and its assembly is illustrated on FIG. 9.

FIGS. 5 and 6 show the detailed structure of the shift dog 9. This shift dog includes two external cylindrical portions 9*a* and 9*b* which do not have the same diameter. The front portion 9*a*, of smaller diameter, includes a smooth edge designed to come to a stop against the counterbore 23 provided on the first member 8. The edge 24 which separates the front and back portions of the shift dog, limits the forward stroke of this shift dog. The walls of the dog clutch bore 25 include helical gears or spiral teeth 19 which are designed to mesh with the grooves 17 of the piston.

The reverse stroke of the dog clutch is limited by the back edge of the back portion 9*b* which includes numerous teeth 26. The axial displacement of the dog clutch causes either one of the two following actions to occur:

The gears or teeth 26 mesh with the complementary gears 27 which are cut in the front end of the fixed part 10. This fixed part also includes a central bore 28 to permit the piston 7 to reciprocate therein as shown in FIGS. 7 and 8.

As the dog clutch is driven forward, the gears 26 are disengaged from the fixed gears 27. The crown or teeth 26 can then rotate freely.

The assembly, positioning and installation of the rotary apparatus components in the body 2 of the drill are performed in the following manner with reference to FIG. 10:

All of the parts are introduced from the back of the bore 3, following the axial direction shown by arrow 11 of FIG. 1.

The counterbores 12 and 13 of the bore 3, the counterbores of the parts to be installed and the axial gears (such as 22 or 26 for instance) are provided to position the various parts in the bore 3 and to provide proper angular location of the various parts.

The tool holder 4, which rotates freely, is introduced through the bore and brought to a stop against the counterbore 12. Its teeth 5 are pointed toward the rear or the handle. The link or moving member 6 is then inserted and fitted in the bore 3 in such a way that its front teeth 22 mesh with the teeth 5 of the tool holder. The first member or seat 8, is press fit into bore 3 so that the front edge rests against the counterbore 13. At this point, the fixed part or first member 8 axially locks the assembly consisting of members 4 and 6 in the bore 3. Furthermore, members 4 and 6 are tied in rotation by the engagement of the teeth 5 and 22.

The dog clutch 9 is then inserted with its gears 26 pointed toward the rear so as to mesh with the front gears of the fixed part 10 which is press-fit into member 8. The axial stroke of the dog clutch 9 is limited by the distance separating its front stop (against the seat counterbore 23) and the end of its reverse stroke (as the gears 26 of the dog clutch are meshed with the gears 27 of the fixed part 10). This stroke should at least exceed the length of gears 26 or 27. With the type of construction illustrated herein, the stroke is actually determined by the contact between a cylindrical embossment 29 of fitting member 10, and the back edge of the seat or first member 8 (FIG. 8). The installation of all of these basic parts is further illustrated in FIGS. 10–14.

Finally, the piston 7 of the drill is inserted in the bore 3. Its installation allows the positioning of the bored parts by rotating them with one another in the following manner:

The grooved, front part of the piston is engaged into the fitting member 10, then into the shift dog 9, in such a way that the helical grooves 17 are meshed with the respective gears 19 of the shift dog 9.

The piston is then driven further in the bore 3, and may be rotated around its axis if necessary. During this operation, the shift dog 9 is driven forward, the gears 26 and 27 are disengaged and the shift dog thus rotates freely with the piston.

The piston-dog clutch assembly is positioned so that the straight, axial gears of the members (rotating) 4, 6 assembly are facing the straight grooves of the piston. It is then possible to mesh the gears 18 with the grooves 16 and tie the tool holder (as well as the tool) and the piston in rotation.

Figure 14:
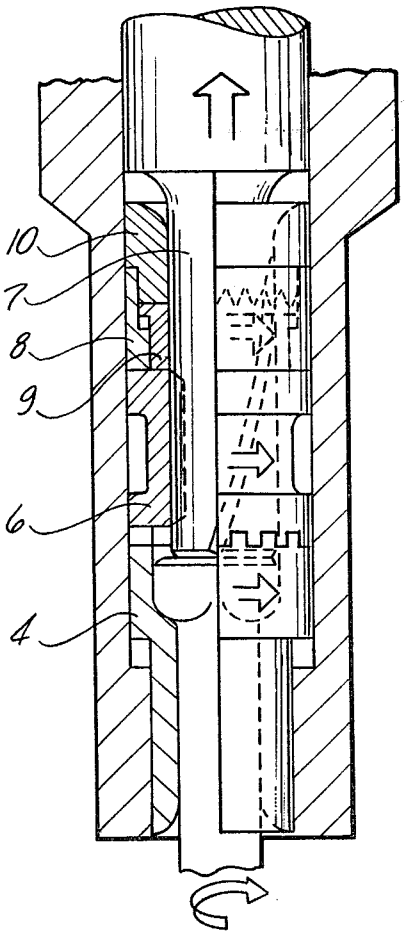
FIGS. 11–14 show the operation of the jack hammer drill.
Figure 13:
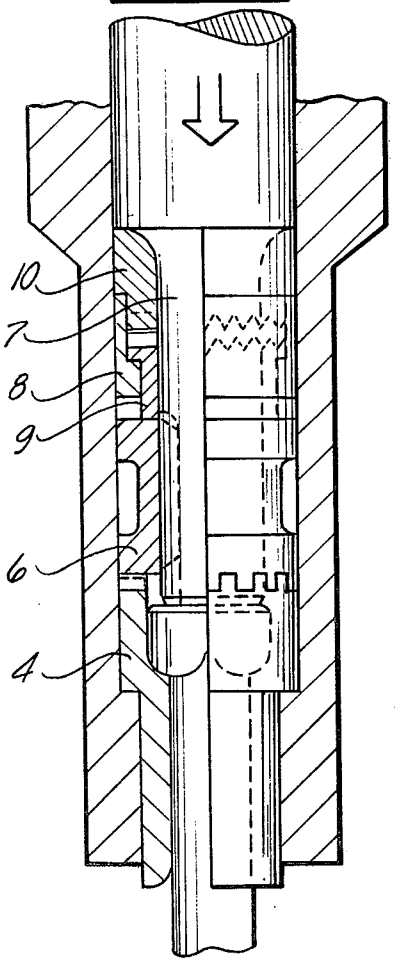
Figure 12:
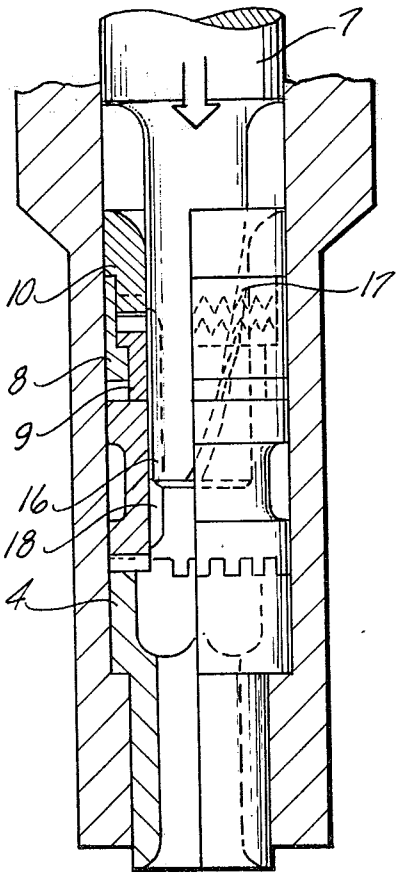
Figure 11:
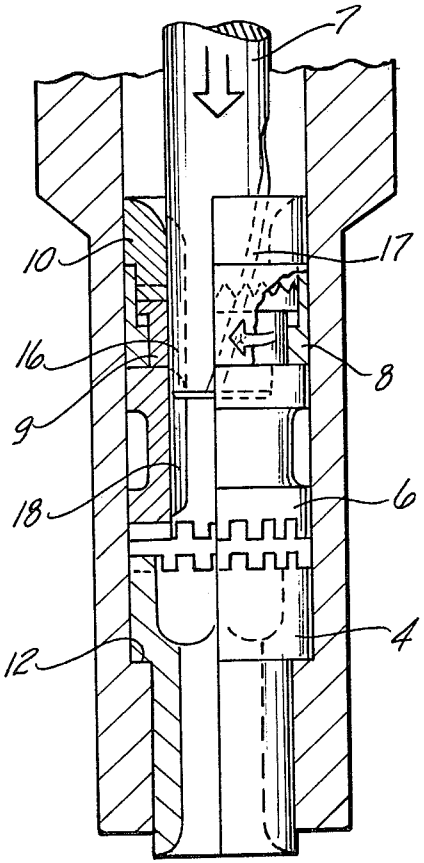

FIGS. 9–14 illustrate the operation mode of the rotary apparatus. FIGS. 9, and 11–13 show the parts at the end of the forward stroke and reverse stroke of piston 7 are illustrated in FIGS. 9 and 14.

The forward stroke of the rotary apparatus begins with air being supplied into the manifold 14 by the action of the control handle 15. The air causes the piston 7 to move in the direction of the arrow shown in FIG. 11. As this occurs, the straight grooves 16 of the piston 7 are engaged with the teeth 18 formed in the internal side wall of the moving member 6. Simultaneously, the helical grooves 17 of the piston 7 engage the helical teeth 19 formed in the bore of the mobile dog clutch 9.

It should be noted that the piston 7 remains in constant mesh with the straight gears of the rotary moving member 6 and with the helical gears of the moving shift clutch 9. Furthermore, a slight play is permitted between the back of the moving member 6 and the front face of first member 8. This play reduces the friction in rotation, without disengaging the gears or teeth 5 of the tool holder from the gears or teeth 22 of the moving member 6.

The shift dog 9 which is meshed with the fitting member 10 through its gears 26, with the fixed gears 27, is moved axially in the same direction 30 as the piston (FIG. 9). At the beginning of the forward stroke, the piston rotates as its helical grooves 17 exert pressure on the helical gears or teeth 19 of the shift dog 9. As the shift dog 9 moves axially, it disengages itself from the fixed fitting member 10. The shift dog 9 is then released and rotates in a free wheel fashion.

The shift dog 9, as it moves axially, pushes the moving member 6 towards the tool holder 4.

At the end of its forward stroke, the piston 7 percusses the tool held in the polygonal opening of the tool holder without rotating since a resisting torque is provided by the tool.

As the piston moves back upward (that is during the reverse stroke), the following can be observed:

The free wheel or shift dog 9 is still engaged by the piston 7. The piston causes the free wheel to move backward (arrow 31, FIG. 9) without rotating.

The teeth 26 of the mobile dog clutch 9 then mesh with the teeth 27 of the fitting member 10. Since the fitting member is non-movable either rotatably or axially, the helical teeth 19 of the mobile dog clutch act on the helical grooves 17 of the piston 7 to cause the piston 7 to rotate about its axis. Thus the piston drives the tool holder 4 in rotation, since they are meshed together through the straight gears or teeth 18 of part 6, and the tooth engagement of teeth 5, of part 6 with the teeth 22 of the tool holder 4.

The axial and rotary displacements of part 9 constitute a mobile dog clutch, and are directly controlled by the piston. Therefore, no return spring is required although such a spring would not impair the operation of the apparatus.

The construction mode illustrated herein remains an example. It is not exhaustive and some design modifications as may be included within the spirit and scope of the invention as defined by the appended claims would still be covered by the invention.

What is claimed is:

1. A rotary drive system wherein a piston is operated by a compressed air distributor to strike a tool of a jack hammer, said rotary drive system comprising:

a housing having a cylindrical bore, said piston mounted at one end of said cylindrical bore;

a rotatable axially fixed tool holder member mounted in the other end of said cylindrical bore;

a moving member mounted in said cylindrical bore adjacent said tool holder member for driving engagement therewith;

a first annular member mounted in said cylindrical bore adjacent said moving member, said first member being non-rotatable and axially fixed with respect to said piston, said first annular member further being mounted in said bore at a predetermined axial position such that said tool holder and said moving member maintain continuous engagement while rotating, said first annular member further having a central bore with a counterbore therein;

a movable annular shift dog member mounted in the central bore of said first member for axial movement relative thereto;

a fitting member mounted in said central bore of the housing adjacent said first member, said fitting member having a stepped outer diameter with one end portion mounted in said central bore of the first annular member; and means for providing rotary driving motion to said tool holder member such that said rotary driving motion imparted to said tool holder causes said piston to strike the tool at the end of the forward stroke without rotating and whereby said piston causes said tool holder member to rotate by the action of the shift dog member during the reversing stroke of the piston.

2. The rotary drive system as claimed in claim 1 wherein said movable annular shift dog member further comprises:

one end face and an opposite end face with a central bore therebetween;

at least one spiral tooth formed in said central bore; and means for rotatably driving said movable annular shift dog member, said driving means mounted on said opposite end face, said means cooperating with said fitting member to allow said movable annular shift dog member to rotate freely during the impact stroke and said means further cooperating with said fitting member to rotate said piston upon the return stroke.

3. The rotary drive system as described in claim 1 wherein said moving member further comprises:

one end face and an opposite end face with a central bore therebetween;

means for engaging said tool holder member mounted on said one end face of the moving member, said engaging means cooperating with said tool holder to rotate said tool holder; and at least one straight tooth formed on the inner diameter of the central bore, said at least one straight tooth communicating with said piston to rotate said moving member and tool holder member after said piston strikes said tool.

4. The rotary drive system as claimed in claim 1 wherein said piston further comprises means for simultaneously engaging said moving shift dog member and said moving member, said simultaneous engaging means mounted on said piston periphery such that when said piston moves in one direction, said piston strikes said tool and whereby when said piston moves in an opposite direction, said simultaneous engagement means act to rotate said tool holder thereby rotating said tool after each impact stroke.

5. The rotary drive system as claimed in claim 1 wherein said central bore of the housing includes at least one counterbore and wherein further said first member is press fitted into said central bore and axially located against said counterbore of the central bore so that said tool holder member and said moving member are engaged to rotate together upon actuation of the rotary drive system.

6. The rotary drive system as claimed in claim 1 wherein said first member further has a stepped central bore with a shoulder portion for receiving said one end portion of said stepped outer diameter of the fitting member and wherein said fitting member further has one end face and a central bore therethrough, said one end face including means for engaging said shift dog member for stopping said shift dog member from rotating during the rearward stroke of the piston.

7. In combination with a jack hammer wherein a tool is impacted by a piston mounted in alignment with said tool, the improvement comprising:

a housing having a bore, said bore having one end portion and an opposite end portion with a shoulder therebetween;

means for holding said tool in axial alignment with said bore, said holding means mounted in said bore for rotatable movement relative thereto;

first means for positioning said holding means in an axially fixed predetermined location in said bore;

a rotatable axially movable annular shift dog member mounted in said first position means for movement relative thereto, said shift dog member having at least one helical spline on its inner diameter adapted to engage said piston; and means for controlling the rotatable movement of said annular shift dog member mounted in said bore, such that upon the forward movement of the piston, the piston engages said means for holding said tool and impacts said tool without rotating and whereby upon the rearward stroke of the piston, said piston cooperates with said shift dog member to rotate said holding means a predetermined amount.

* * * * *

UNITED STATES PATENT AND TRADEMARK OFFICE

CERTIFICATE OF CORRECTION

PATENT NO. : 4,319,646

DATED : March 16, 1982

INVENTOR(S) : Henri Emonet

It is certified that error appears in the above-identified patent and that said Letters Patent is hereby corrected as shown below:

Column 1, line 11, after "hammers" insert - - - , - - -.

Column 2, line 8, delete "interfere" and insert - - - interface --- -.

Column 2, line 57, delete "position" and insert - - - piston - - -.

Column 2, line 58, delete "with the tool".

Column 2, line 59, delete "holder.".

Column 3, line 37, delete "jack-hammer" and insert - - - jack hammer - - -.

Column 3, line 50, delete "side-wall" and insert - - - side wall - - -.

Column 3, line 55, delete "side-wall" and insert - - - side wall - - -.

Column 3, line 64, delete "side-wall" and insert - - - side wall - - -.

Column 5, line 24, after "and" insert - - - the - - -.

UNITED STATES PATENT AND TRADEMARK OFFICE

CERTIFICATE OF CORRECTION

PATENT NO. : 4,319,646

DATED : March 16, 1982

INVENTOR(S) : Henri Emonet

It is certified that error appears in the above-identified patent and that said Letters Patent is hereby corrected as shown below:

Column 5, line 25, delete "are" and insert - - - is - - -.

Column 5, line 46, delete "with" and insert - - - and - - -.

Signed and Sealed this

*Seventh* Day of *June 1983*

[SEAL]

*Attest:*

DONALD J. QUIGG

*Attesting Officer*

*Acting Commissioner of Patents and Trademarks*